US010340616B2

(12) United States Patent
Pares Caselles et al.

(10) Patent No.: US 10,340,616 B2
(45) Date of Patent: Jul. 2, 2019

(54) ELECTRICAL TERMINAL STRUCTURE FOR REDUCING TERMINAL SPACING

(71) Applicant: Lear Corporation, Southfield, MI (US)

(72) Inventors: Josep Maria Pares Caselles, Valls (ES); Elena Cortes, Valls (ES); Salvador Bonjoch Cots, Valls (ES); Josep Maria Combalia San-Román, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/656,459

(22) Filed: Jul. 21, 2017

(65) Prior Publication Data

US 2019/0027844 A1 Jan. 24, 2019

(51) Int. Cl.
*H01R 12/58* (2011.01)
*H01R 43/20* (2006.01)

(52) U.S. Cl.
CPC ..... *H01R 12/58* (2013.01); *H01R 43/205* (2013.01)

(58) Field of Classification Search
CPC ..... H01R 12/58; H01R 43/205
USPC ... 439/78, 83, 84, 733.1, 751, 873, 890, 855
See application file for complete search history.

(56) References Cited

U.S. PATENT DOCUMENTS 3,848,952 A * 11/1974 Tighe, Jr. ..... H01R 12/83 439/326
4,136,917 A * 1/1979 Then ..... H01R 12/83 361/801
4,188,715 A * 2/1980 Ammon ..... H01R 12/585 29/884
4,575,172 A * 3/1986 Walse ..... H01R 12/83 439/326
4,612,529 A 9/1986 Gurevich et al.
4,718,859 A * 1/1988 Gardner ..... H01R 12/83 439/326
4,781,612 A * 11/1988 Thrush ..... H01R 12/716 439/328
4,826,446 A * 5/1989 Juntwait ..... H01R 12/83 439/326
4,832,617 A * 5/1989 Brown ..... H01R 12/83 439/326
4,850,892 A * 7/1989 Clayton ..... H01R 12/7005 439/326
5,064,391 A * 11/1991 Buchter ..... H01R 13/422 439/733.1
5,428,505 A 6/1995 Sakemi et al.
5,807,142 A * 9/1998 O'Sullivan ..... H01R 13/41 439/733.1
6,280,253 B1 8/2001 Kraus et al.
(Continued)

*Primary Examiner* — Travis S Chambers
(74) *Attorney, Agent, or Firm* — Fishman Stewart PLLC

(57) ABSTRACT

An electrical terminal includes a body, a first tab extending from a first side of the body, and a second tab extending from a second side of the body. The second tab may be vertically offset, in a longitudinal direction of the body, from the first tab. The first tab and the second tab may extend in substantially opposite directions. An offset distance between the first tab and the second tab may be less than about half of a height of the first tab. The first tab may be disposed such that upon connection of the electrical terminal with a circuit board, the first tab contacts a surface of the circuit board. The second tab may be disposed such that upon connection of the electrical terminal with said circuit board, the second tab does not contact the circuit board.

20 Claims, 6 Drawing Sheets

(56) References Cited

U.S. PATENT DOCUMENTS

| | | | | |
|---|---|---|---|---|
| 6,666,722 | B2 | 12/2003 | Fukumori et al. | |
| 6,878,004 | B2 | 4/2005 | Oh | |
| 6,891,463 | B2 | 5/2005 | Nagaoka | |
| 6,997,727 | B1 * | 2/2006 | Legrady | H01R 12/57 439/246 |
| 7,322,847 | B2 | 1/2008 | Hashim et al. | |
| 7,361,031 | B2 * | 4/2008 | Matsumura | H01R 12/585 29/845 |
| 7,491,101 | B2 * | 2/2009 | Irish | H01R 11/22 439/853 |
| 7,710,236 | B2 | 5/2010 | Jozwiak | |
| 7,905,732 | B2 | 3/2011 | Chung | |
| 8,002,594 | B2 * | 8/2011 | Cheng | H01R 13/24 439/862 |
| 9,831,575 | B2 * | 11/2017 | Eakins | H01R 4/028 |
| 2015/0235733 | A1 * | 8/2015 | Fox | H05K 1/18 174/261 |
| 2016/0141776 | A1 | 5/2016 | Eakins et al. | |

* cited by examiner

ELECTRICAL TERMINAL STRUCTURE FOR REDUCING TERMINAL SPACING

TECHNICAL FIELD

The present disclosure generally relates to electrical terminals, such as terminals used in connection with circuit boards and/or electrical components.

BACKGROUND

This background description is set forth below for the purpose of providing context only. Therefore, any aspect of this background description, to the extent that it does not otherwise qualify as prior art, is neither expressly nor impliedly admitted as prior art against the instant disclosure.

With some terminals, it may not be possible to dispose adjacent terminals sufficiently close together. Other terminals may not be configured for large-scale production.

There is a desire for solutions/options that minimize or eliminate one or more challenges or shortcomings of electrical terminals. The foregoing discussion is intended only to illustrate examples of the present field and should not be taken as a disavowal of scope.

SUMMARY

In embodiments, an electrical terminal may include a body, a first tab extending from a first side of the body, and/or a second tab extending from a second side of the body. The second tab may be vertically offset, in a longitudinal direction of the body (e.g., a vertical direction), from the first tab. The first tab and the second tab may extend in substantially opposite directions (e.g., opposite lateral directions). An offset distance between the first tab and the second tab may be less than about half of a height of the first tab. The first tab may be disposed such that upon connection of the electrical terminal with a circuit board, the first tab contacts a surface of the circuit board. The second tab may be disposed such that upon connection of the electrical terminal with said circuit board, the second tab does not contact the circuit board. The body, the first tab, and/or the second tab may be planar and may extend in a common plane (e.g., a plane perpendicular to the circuit board).

With embodiments, an electrical terminal may include a connection portion for connecting with a terminal of an electrical component. A connection portion may include a pair of opposing arms. A connection portion may include a blade configuration. An electrical terminal may include one or more protrusions configured for connection with a circuit board. A body may include a first recess and a second recess disposed on opposite sides of the protrusion. The first tab may provide a first contact portion for contacting said circuit board. An electrical terminal may include a projection extending from the body and/or the projection may provide a second contact portion for contacting said circuit board. A first recess may be disposed at least partially between (e.g. laterally) the first tab and the protrusion. A second recess may be disposed at least partially between the protrusion and the projection.

In embodiments, an electrical terminal may include a projection extending downward from the body. A first tab may provide a first contact portion for contacting a circuit board and a projection may provide a second contact portion for contacting said circuit board. A first tab may include a substantially horizontal first edge, a substantially vertical second edge, and/or a substantially horizontal third edge. The second tab may include a substantially horizontal first edge, a substantially vertical second edge, and/or a substantially horizontal third edge. A third edge of a first tab may be vertically offset from the first edge of the second tab.

With embodiments, a plurality of electrical terminals may be connected in a reel configuration. A second tab of at least one of the plurality of electrical terminals may be connected to the first side of an adjacent electrical terminal via a first connecting member. A first tab of the at least one of the plurality of electrical terminals may be connected to A second side of the adjacent terminal via a second connecting member.

In embodiments, a circuit board assembly may include a circuit board and a plurality of terminals connected to the circuit board. A terminal may include a body, a first tab extending from a first side of the body, and/or a second tab extending from a second side of the body. The second tab may be offset, in a longitudinal direction of the body, from the first tab. The plurality of terminals may include a first terminal and a second terminal disposed in parallel with each other such that a tab of the first terminal is aligned (e.g., in a vertical direction and/or a longitudinal direction of a terminal body) between a second tab of the second terminal and the circuit board. A first tab of a first terminal and a first tab of the second terminal may be in contact with the circuit board. The second tab of the first terminal and the second tab of the second terminal may not be in contact with the circuit board. The first terminal may include a projection disposed opposite the first tab of the first terminal and below the second tab of the first terminal. The projection of the first terminal may be in contact with the circuit board. The second terminal may include a projection disposed opposite the first tab of the second terminal and below the second tab of the second terminal. The projection of the second terminal may be in contact with the circuit board.

The foregoing and other aspects, features, details, utilities, and/or advantages of embodiments the present disclosure will be apparent from reading the following description, and from reviewing the accompanying drawings.

DETAILED DESCRIPTION

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications and equivalents, which may be included within the spirit and scope of the present disclosure as defined by the appended claims.

Figure 1A:
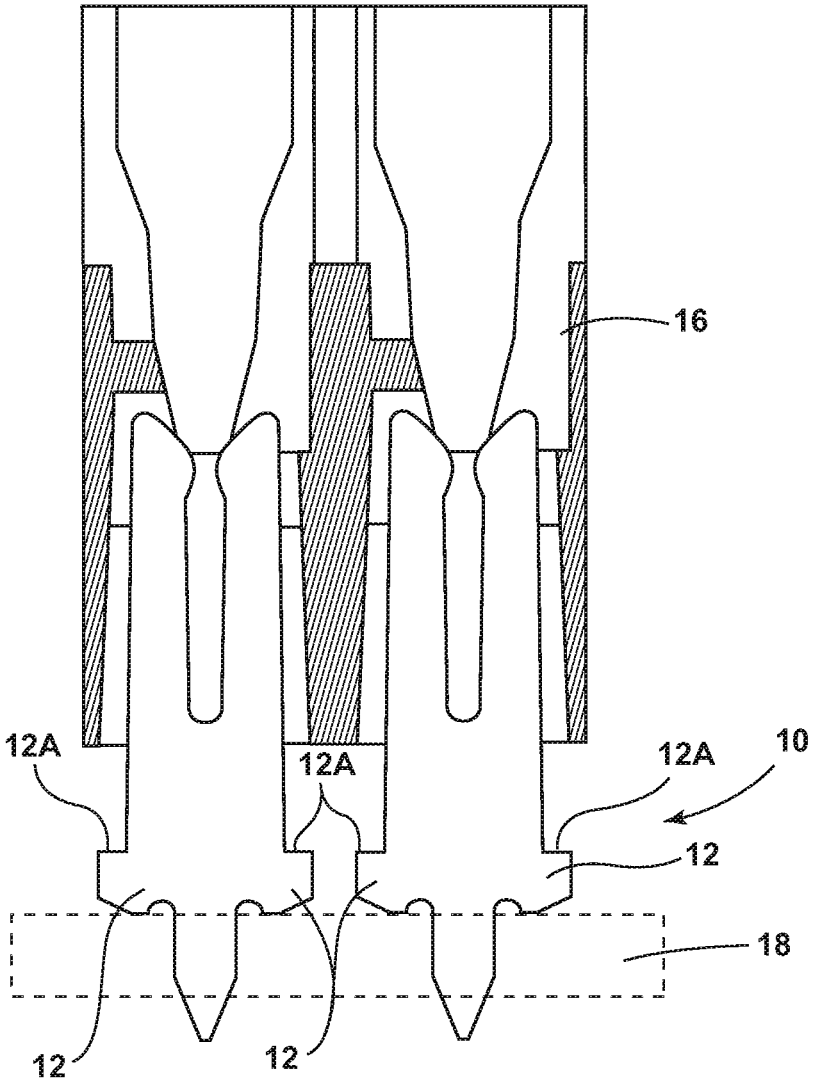
FIG. 1A (PRIOR ART)
FIGS. 1A and 1B are cross-sectional views generally illustrating electrical terminals connected with housings.

In some circumstances, such as generally illustrated in FIG. 1A, electrical terminals 10 may be connected with a housing 16 and/or a circuit board 18. Terminals 10 may be disposed adjacent to each other, but outer dimensions of terminals 10 may limit how close adjacent terminals 10 can be aligned next to each other and/or may restrict the assembly process. Some terminals 10 may include tabs 12. Tabs 12 may limit an insertion depth of a terminal 10 into a circuit board. Terminals 10 may be automatically inserted into a circuit board 18 by an insertion machine. The insertion machine may apply a substantially perpendicular force (e.g., relative to a plane of circuit board 18) to terminals 10, such as via top edges 12A of tabs 12. It may be desirable for terminals 10 to be a short as possible (e.g., above circuit board 18) so that a height of a circuit board assembly and/or housing 16 is as small as possible. Additionally or alternatively, it may be desirable to include a minimum separation distance between adjacent terminals 10 to prevent short-circuiting between adjacent terminals 10, such as due to manufacturing and/or assembly tolerances. It may also be desirable to dispose terminals 10 as close together as possible to limit the size of circuit board 18.

Figure 1B:
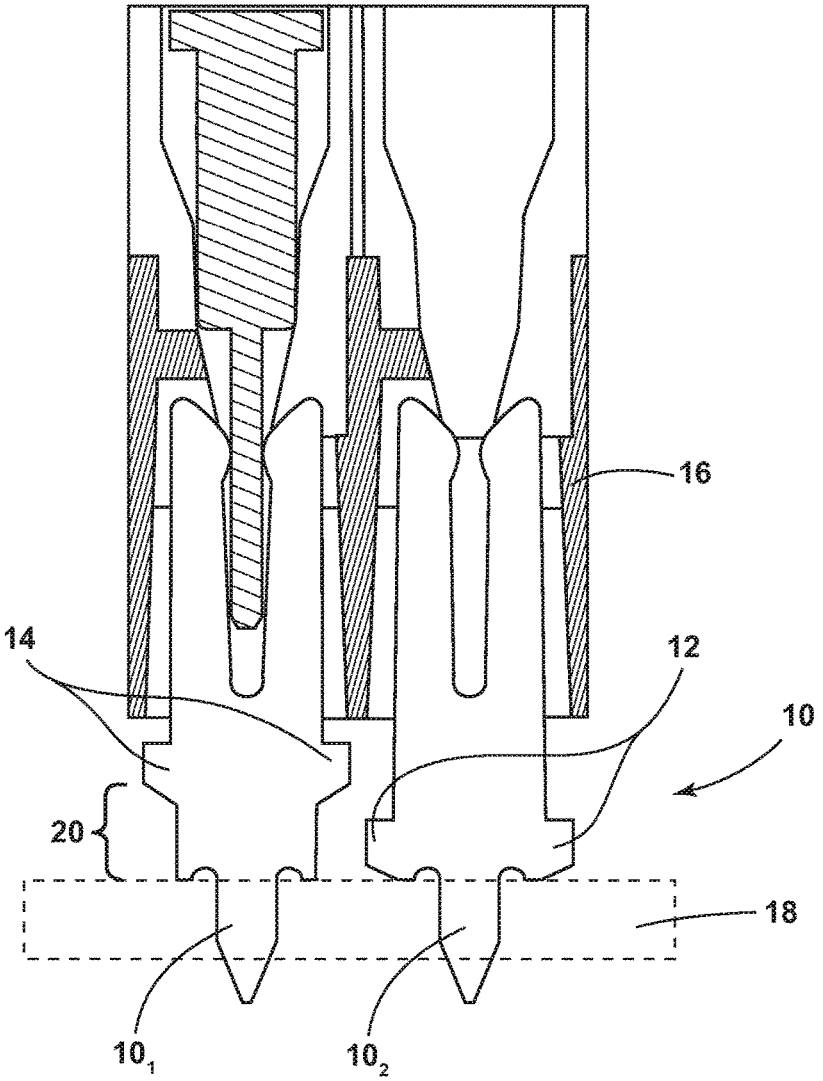
FIG. 1B (PRIOR ART)
Figure 2:
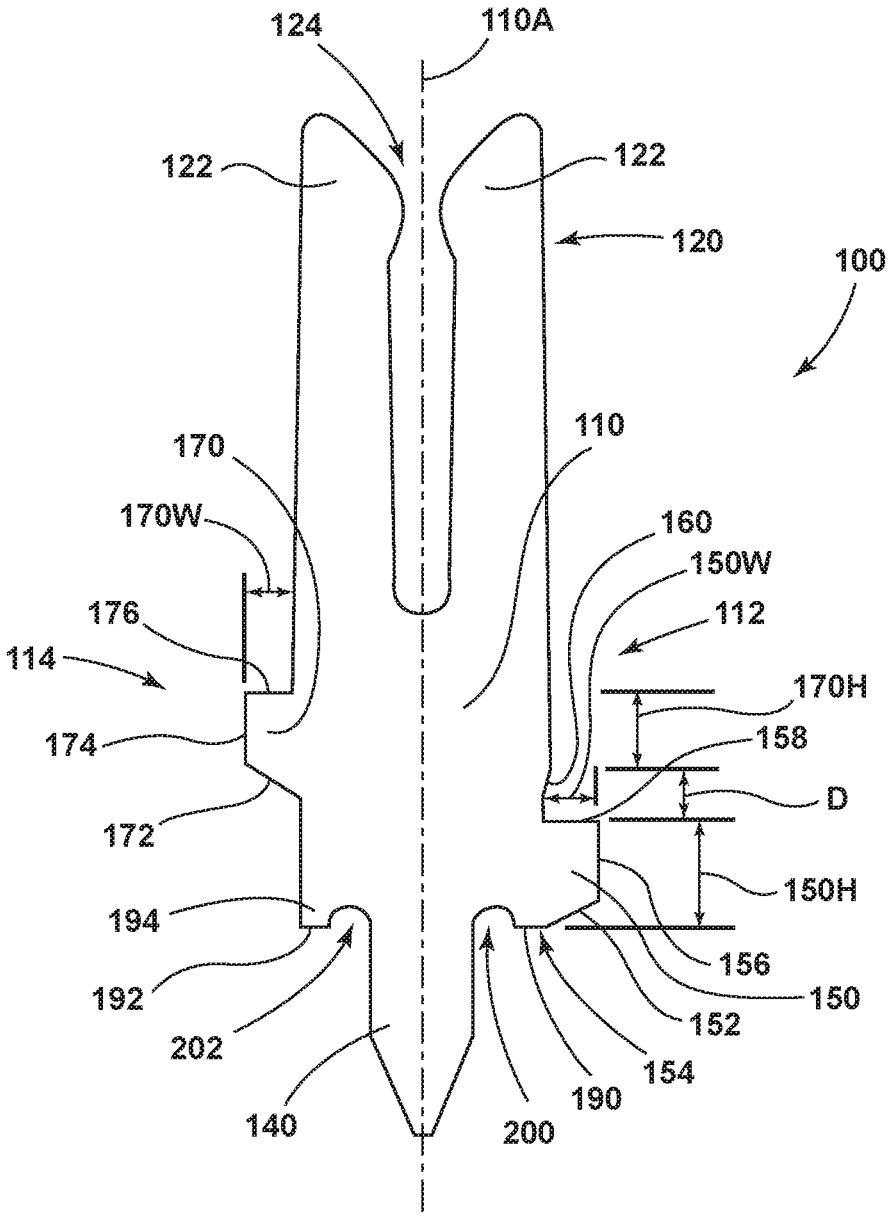
FIG. 2 is a side view generally illustrating an embodiment of an electrical terminal according to teachings of the present disclosure.

With some terminals, such as generally illustrated in FIG. 1B, a set of terminals (e.g., terminal $\mathbf{10}_1$ and terminal $\mathbf{10}_2$) may include two types of terminals. A first type of terminal (e.g., terminal $\mathbf{10}_1$) may include a first configuration and a second type of terminal (e.g., terminal $\mathbf{10}_2$) may include a second configuration. The first and second configurations may be different and complementary. For example and without limitation, the first configuration may include a lower pair of tabs 12 and the second configuration may include a raised pair of tabs 14. Lower pair of tabs 12 may, when terminals $\mathbf{10}_1$, $\mathbf{10}_2$ are connected with a circuit board 18, be disposed at least partially below raised pair of tabs 14 (e.g., lower tabs 12 may fit in and/or be aligned with a vertical gap 20 between raised tabs 14 and circuit board 18). Utilizing two different configurations of terminals (e.g., terminals $\mathbf{10}_1$, $\mathbf{10}_2$) may allow terminals to be disposed closer together relative to terminals with parallel tabs (e.g., terminals 10 of FIG. 1A) while maintaining a certain minimum separation. However, utilizing two different configurations of terminals may be relatively expensive, involve more complex assembly processes, and/or may be less efficient (e.g., may involve a sequential insertion process).

Figure 3:
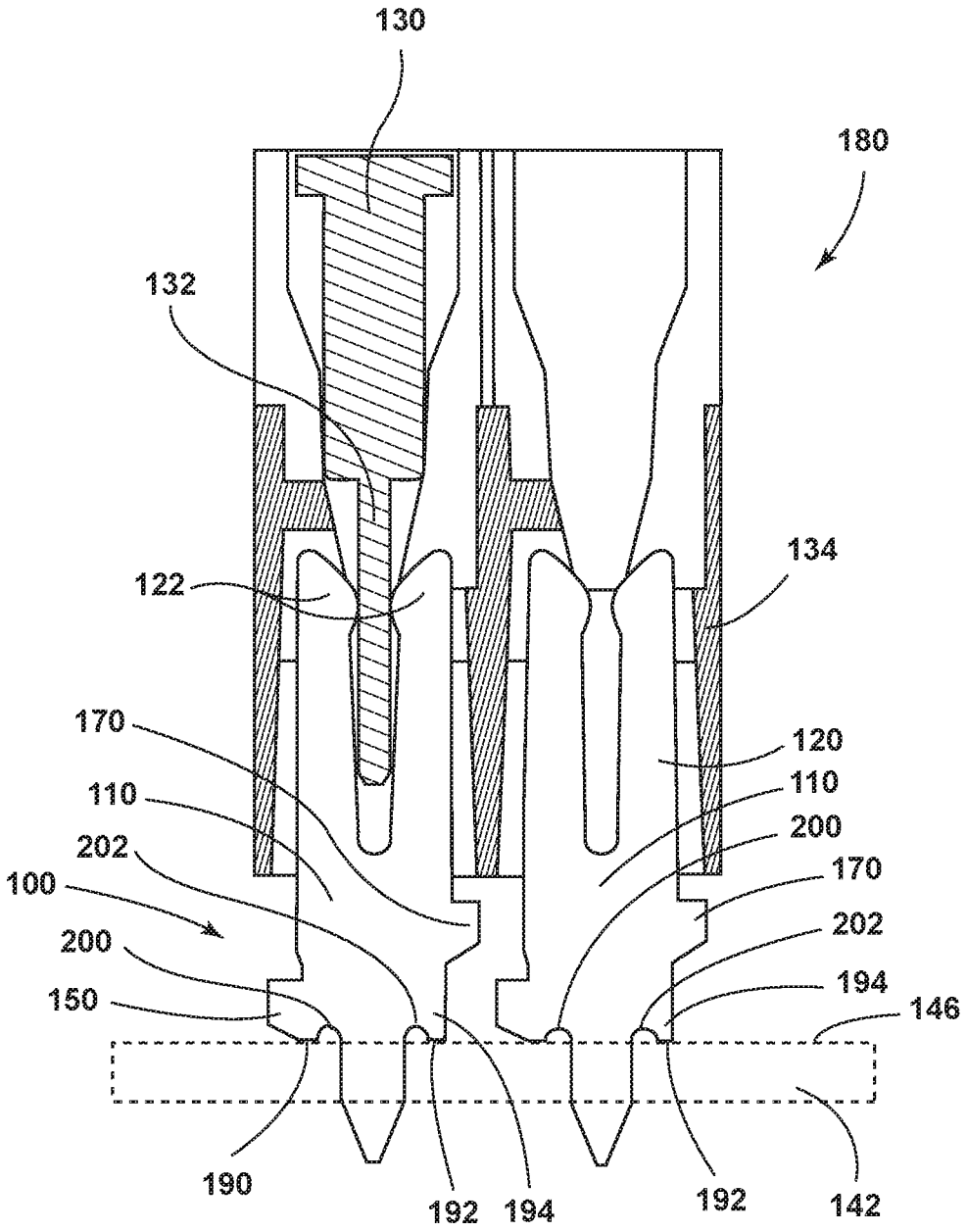
FIG. 3 is a cross-sectional view generally illustrating embodiments of electrical terminals connected with a housing according to teachings of the present disclosure.
Figure 4:
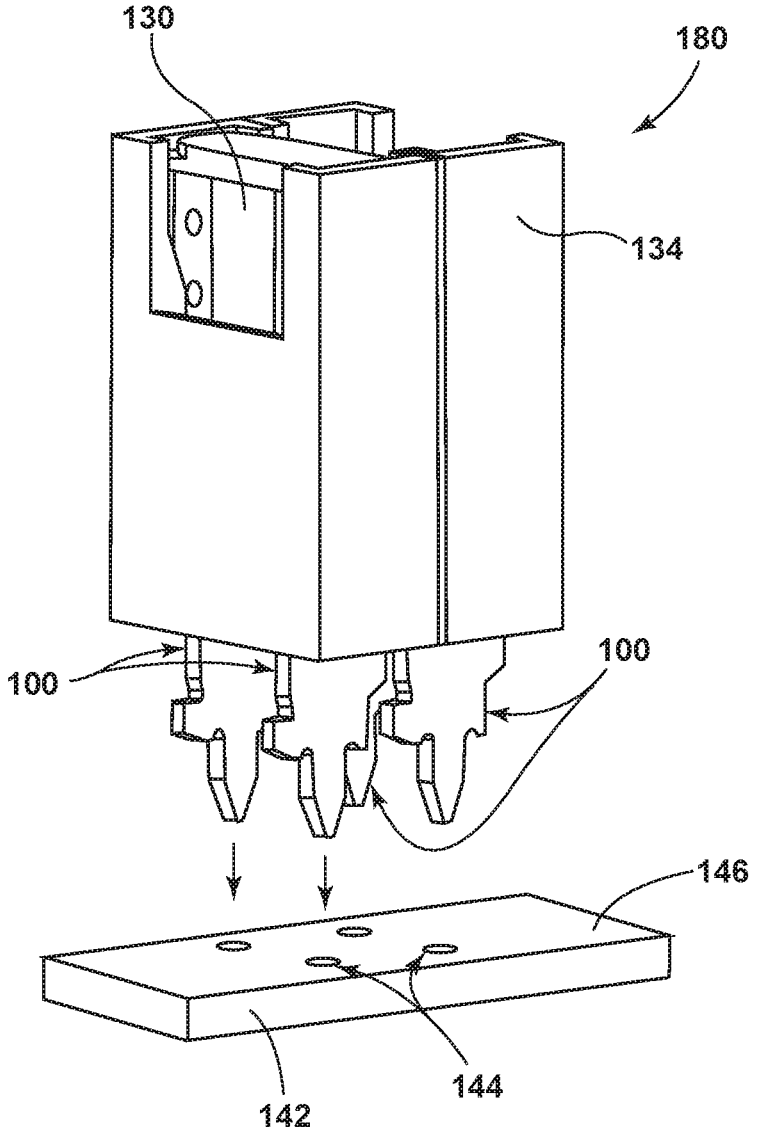
FIG. 4 is a perspective view generally illustrating embodiments of electrical terminals connected with a housing according to teachings of the present disclosure.

In embodiments, such as generally illustrated in FIGS. 2, 3, 4, and 5, an electrical terminal 100 may include one or more of a variety of shapes, sizes, configurations, and/or materials. For example and without limitation, an electrical terminal 100 may be configured as a flat female terminal, but may include other configurations. An electrical terminal 100 may include electrically conducting material (e.g., copper, aluminum, gold, silver, etc.). An electrical terminal 100 may include a body 110 and/or a connection portion 120 that may be configured for electrical connection with another terminal. In embodiments, connection portion 120 may include a pair of opposing arms 122 that may be configured to receive another terminal, such as a blade terminal 132 of an electrical component 130 (e.g., a micro fuse or mini fuse, such as generally illustrated in FIGS. 3 and 4). With embodiments, a connection portion 120 may be configured as a blade and/or may be configured for insertion into an electrical component 130. An electrical component 130 may be connected with a housing 134 and/or terminal 130 may extend into housing 134. Arms 122 may extend substantially vertically upward from body 110 and may provide a gap 124 (e.g., in a lateral direction) into which another terminal (e.g., blade terminal 132) may be inserted. Electrical terminal 100 may include one or more protrusions 140 that may extend (e.g., vertically downward) from body 110 and/or may be configured for insertion into a circuit board 142. Protrusion 140 may be substantially centered on a longitudinal axis 110A of body 110. Electrical terminal 100 may be substantially planar and/or may be configured to receive another terminal disposed perpendicularly to electrical terminal 100 (e.g., blade terminal 132 of electrical component 130 may be disposed in a plane perpendicular to that of electrical terminal 100). While electrical terminal 100 is generally illustrated with one protrusion 140, an electrical terminal 100 may include a plurality of protrusions 140, such as, for example, two protrusions or three protrusions. The number of protrusions 140 may correspond to a width of the protrusions 140 and/or a desired electrical current capacity.

With embodiments, an electrical terminal 100 may include a first tab 150 and/or a second tab 170 (e.g., insertion tabs). First tab 150 may be disposed at and/or extend from a first side 112 of body 110. First tab 150 may have a generally trapezoidal shape and/or may include a tapered section 152. A first edge 154 of first tab 150 may be configured to contact a circuit board 142 and/or may be substantially perpendicular to longitudinal axis 110A of body 110. Tapered section 152 may be a part of and/or extend from first edge 154. Tapered section 152 may extend to a second edge 156 of first tab 150 that may be substantially parallel with longitudinal axis 110A. A third edge 158 may extend in a substantially perpendicular direction from body 110 ((relative to longitudinal axis 110A) and/or may connect with second edge 156. Body 110 may include a tapered edge 160 that may be disposed proximate and/or lead into third edge 158. A first tab 150 may include a width 150W and a second tab 170 may include a width 170W.

In embodiments, a second tab 170 may be disposed at and/or extend from a second side 114 of body 110 that may be opposite from first side 112. Second tab 170 may, for example, have a generally trapezoidal shape. First tab 150 and/or second tab 170 may, for example, extend in substantially opposite lateral directions (e.g., perpendicularly to longitudinal axis 110A). Second tab 170 may include a first edge 172 that may extend from second side 114 of body 110. First edge 172 may be disposed at an angle (e.g., an oblique angle) relative to longitudinal axis 110A. Second tab 170 may include a second edge 174 that may extend from first edge 172 and/or may extend substantially parallel to longitudinal axis 110A. Second tab 170 may include a third edge 176 that may extend in a substantially perpendicular direction from body 110 and/or may be connected with second edge 174.

With embodiments, first tab 150 may be offset from second tab 170 (e.g., first tab 150 and second tab 170 may include/be disposed in an asymmetric configuration). For example and without limitation, third edge 158 of first tab 150 may be disposed at a distance D (e.g., an offset distance in the direction of longitudinal axis 110A) from first edge 172 of second tab 170. Distance D may, for example only, be about half or less than a height 150H of first tab 150 and/or a height 170H of second tab 170.

In embodiments, such as generally illustrated in FIGS. 3 and 4, a plurality of electrical terminals 100 may be connected to a circuit board 142. Each of the plurality of electrical terminals 100 may be substantially identical and/or may include asymmetric insertion tabs 150, 170.

With embodiments, a method of assembling a circuit board assembly 180 may include connecting a plurality of substantially identical electrical terminals 100 with a circuit board 142. Connecting an electrical terminal 100 to a circuit board 142 may include inserting a protrusion 140 of each electrical terminal 100 into a corresponding aperture 144 of the circuit board 142. In embodiments, insertion may be conducted via an insertion machine that may apply an insertion force to one or more electrical terminals 100. For example and without limitation, an insertion machine may apply an insertion force directed generally perpendicular to circuit board 142 to a third edge 158 of a first tab 150 and/or a third edge 176 of a second tab 170. Insertion may continue, for example, until one or more contact portions of electrical terminal(s) 100 contact circuit board 142 (e.g., a top surface 146 of circuit board 142). In embodiments, a first contact portion 190 of electrical terminal 100 may be provided by first edge 154 of first tab 150. A second contact portion 192 of electrical terminal 100 may be provided by a projection 194 that may be disposed at and/or extend from an opposite side (e.g., second side 114) of body 110 (e.g., below second tab 170). Projection 194 may extend in a direction substantially parallel or parallel with longitudinal axis 110A. Projection 194 may not extend laterally outward from body 110.

With embodiments, upon insertion of an electrical terminal 100 into a circuit board 142, a first contact portion 190 of a first tab 150 and a second contact portion 192 of a projection 194 may be the only portions of electrical terminal 100 that contact a top of circuit board 142 and/or second tab 170 may not contact circuit board 142. In embodiments, body 110, protrusion 140, first tab 150, second tab 170, and/or projection 194 may be planar and/or may extend in a common plane (e.g. a plane perpendicular to circuit board 142). A plurality of electrical terminals 100 may be connected to a circuit board 142 at substantially the same time (e.g., simultaneously). A first electrical terminal 100 and a second electrical terminal 100 may be disposed adjacent to each other and/or may be connected to a circuit board 142 in a parallel configuration (e.g., first and second terminals 100 may extend in a common plane). A first electrical terminal 100 may include a first tab 150 that may be aligned between a second tab 170 of a second terminal 100 and a circuit board 142. For example and without limitation, a top/third edge 158 of first tab 150 may be at a lower vertical position (relative to circuit board 142) compared to a lower/first edge 176 of second tab 170 of second terminal 100, and first tab 150 of the first terminal 100 may or may not overlap with second tab 170 of the second terminal 100 in a vertical direction.

In embodiments, a body 110 may include one or more recesses, such as a first recess 200 and/or a second recess 202. For example and without limitation, first recess 200 may be disposed at least partially between (e.g., in a lateral direction) first tab 150 and protrusion 140 and/or second recess 202 may be disposed at least partially between (e.g., lateral direction) projection 194 and protrusion 140. First recess 200 and/or second recess 202 may be configured to compensate for copper and/or PTH (plated through hole) plating that may be displaced during insertion of an electrical terminal 100 into a circuit board 142. For example and without limitation, displaced copper and/or plating may accumulate in one or more of first recess 200 and second recess 202 instead of accumulating under contact portions 190, 192. Displaced copper and/or plating might otherwise prevent contact portions 190, 192 from contacting circuit board 142 and/or from being sufficiently close to circuit board 142 (e.g., sufficiently close to provide stability).

Figure 5:
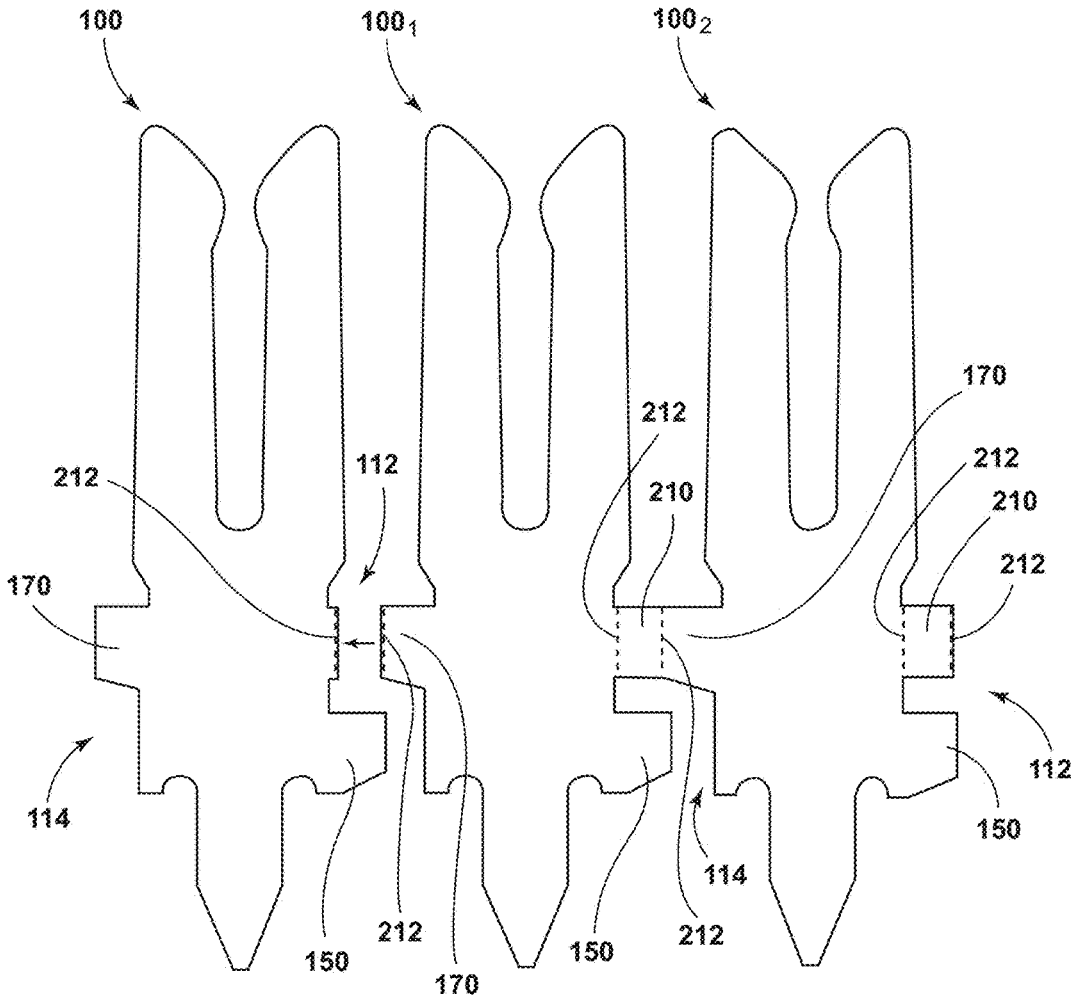
FIG. 5 is a side view generally illustrating embodiments of electrical terminals according to teachings of the present disclosure.

With embodiments, such as generally illustrated in FIG. 5, a plurality of electrical terminals 100 may be created/formed in a reel configuration. In a reel configuration, electrical terminals 100 may include one or more connecting members 210 that may be connected to adjacent electrical terminals 100 (e.g., to a first side 112 of a first terminal $\mathbf{100}_1$ and a second tab 170 of a second terminal $\mathbf{100}_2$). Connecting member(s) 210 and/or electrical terminals 100 may include one or more designated break sections 212 at or about which connecting member(s) 210 may be configured to break away from an electrical terminal 100. With embodiments, in a reel configuration, a connecting member 210 may be connected to a first tab 150 of a first terminal 100 and a second side 114 of a second terminal 100. In a reel configuration, connecting members 210 may provide a connection (i) between first tabs 150 and second sides 114, (ii) between second tabs 170 and first sides 112, or (iii) between first tabs 150 and second sides 114 and between second tabs 170 and first side 112.

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. Uses of "and" and "or" are to be construed broadly (e.g., to be treated as "and/or"). For example, and without limitation, uses of "and" do not necessarily require all elements or features listed, and uses of "or" are intended to be inclusive unless such a construction would be illogical.

It is intended that all matter contained in the above description or shown in the accompanying drawings shall be interpreted as illustrative only and not limiting. Changes in detail or structure may be made without departing from the present disclosure.

Furthermore, the mixing and matching of features, elements and/or functions between various examples is expressly contemplated herein so that one of ordinary skill in the art would appreciate from this disclosure that features, elements, and/or functions of one example may be incorporated into another example as appropriate, unless described otherwise, above. Moreover, many modifications may be made to adapt a particular situation or material to the teachings of the present disclosure without departing from the scope thereof. Therefore, it is intended that the present teachings not be limited to the particular examples illustrated by the drawings and described in the specification, but that the scope of the present disclosure will include any embodiments falling within the foregoing description and the appended claims.

What is claimed is:

1. An electrical terminal, comprising:

a body;

a first tab extending from a first side of the body; and a second tab extending from a second side of the body;

wherein the second tab is vertically offset, in a longitudinal direction of the body, from the first tab; the first tab is disposed such that upon connection of the electrical terminal with a circuit board, the first tab contacts a surface of said circuit board; and the second tab is disposed such that upon connection of the electrical terminal with said circuit board, the second tab does not contact said circuit board.

2. The electrical terminal of claim 1, wherein the first tab and the second tab extend in substantially opposite directions.

3. The electrical terminal of claim 1, wherein an offset distance between the first tab and the second tab is less than about half of a height of the first tab.

4. The electrical terminal of claim 1, wherein the first tab and the second tab extend from a bottom half of the body.

5. The electrical terminal of claim 1, wherein the body, the first tab, and the second tab are planar and extend in a common plane.

6. The electrical terminal of claim 1, including a connection portion for receiving a blade terminal of an electrical component, the connection portion including a pair of opposing arms.

7. The electrical terminal of claim 1, including a connection portion having a blade configuration.

8. The electrical terminal of claim 1, wherein the first tab, the second tab, and the body are substantially planar and disposed in parallel with each other.

9. The electrical terminal of claim 1, including a projection extending downward from the body, wherein the first tab provides a first contact portion for contacting said circuit board and the projection provides a second contact portion for contacting said circuit board.

10. The electrical terminal of claim 1, including one or more protrusions configured for connection with said circuit board.

11. The electrical terminal of claim 10, wherein the body includes a first recess and a second recess disposed on opposite sides of a protrusion of the one or more protrusions.

12. The electrical terminal of claim 10, including a projection extending from the body, the projection providing a contact portion for contacting said circuit board.

13. The electrical terminal of claim 12, wherein a first recess is disposed at least partially between the first tab and a protrusion of the one or more protrusions, and a second recess is disposed at least partially between the protrusion and the projection.

14. The electrical terminal of claim 1, wherein the first tab includes a substantially horizontal first edge, a substantially vertical second edge, and a substantially horizontal third edge; and the second tab includes a substantially horizontal first edge, a substantially vertical second edge, and a substantially horizontal third edge.

15. The electrical terminal of claim 14, wherein the third edge of the first tab is vertically offset from the first edge of the second tab.

16. A plurality of electrical terminals, each electrical terminal of the plurality of electrical terminals comprising:

a body;

a projection extending downward from the body;

a first tab extending from a first side of the body; and a second tab extending from a second side of the body;

wherein the second tab is vertically offset, in a longitudinal direction of the body, from the first tab;

wherein the plurality of electrical terminals are connected in a reel configuration; and (i) the second tab of at least one of the plurality of electrical terminals is connected to the first side of an adjacent electrical terminal of the plurality of electrical terminals via a first connecting member, and (ii) the first tab of the at least one of the plurality of electrical terminals is connected to the second side of the adjacent electrical terminal via a second connecting member;

wherein the first tab provides a first contact portion for contacting a circuit board and the projection provides a second contact portion for contacting said circuit board.

17. The plurality of electrical terminals of claim 16, wherein the second tab of each electrical terminal is disposed such that upon connection of the electrical terminal with said circuit board, the second tab does not contact said circuit board.

18. A circuit board assembly, comprising:

a circuit board; and a plurality of terminals connected to the circuit board, each terminal of the plurality of terminals including:

a body;

a first tab extending from a first side of the body; and a second tab extending from a second side of the body, the second tab offset, in a longitudinal direction of the body, from the first tab;

wherein the plurality of terminals includes a first terminal and a second terminal disposed in parallel with each other such that the first tab of the first terminal is aligned between the second tab of the second terminal and the circuit board; the first tab of the first terminal and the first tab of the second terminal are in contact with the circuit board; and the second tab of the first terminal and the second tab of the second terminal are not in contact with the circuit board.

19. The circuit board assembly of claim 18, wherein the first tab of the first terminal, the second tab of the first terminal, and the body of the first terminal are substantially planar and disposed in parallel with each other.

20. The circuit board assembly of claim 18, wherein the first terminal includes a projection disposed opposite the first tab of the first terminal and below the second tab of the first terminal; the projection of the first terminal is in contact with the circuit board; the second terminal includes a projection disposed opposite the first tab of the second terminal and below the second tab of the second terminal; and the projection of the second terminal is in contact with the circuit board.

* * * * *